United States Patent [19]

Rodríquez Salcedo

[11] Patent Number: 4,852,432

[45] Date of Patent: Aug. 1, 1989

[54] BOTTLE CAP OPENER

[76] Inventor: Manuel de Jesûs Rodríquez Salcedo, c/o Banco de Reservas de la Rep. Dominicana, John F. Kennedy #16, Puerto Plata, Dominican Republic

[21] Appl. No.: 107,462

[22] Filed: Oct. 13, 1987

[51] Int. Cl.[4] ..... B67B 7/16

[52] U.S. Cl. ..... 81/3.08; 81/3.56

[58] Field of Search ..... 81/3.36, 3.08, 3.56, 81/3.55

[56] References Cited

U.S. PATENT DOCUMENTS

| | | | |
|---|---|---|---|
| 1,250,448 | 12/1917 | Green | 81/3.36 |
| 2,542,329 | 2/1951 | Hammond, Jr. | 81/3.08 |
| 2,551,511 | 5/1951 | Talbot | 81/3.56 |
| 2,651,957 | 9/1953 | Phillips | 81/356 |

*Primary Examiner*—Roscoe V. Parker

*Attorney, Agent, or Firm*—Sughrue, Mion, Zinn, Macpeak & Seas

[57] ABSTRACT

A bottle cap opener in the form of a fixed base includes a laterally directed U-shaped bottle neck embracing hollow portion for receiving a portion of the neck of the bottle below a rim. A lever is pivotally mounted to and overlies the base. The lever includes a front arm having an end abutting the U-shaped hollow portion of the base and engagable with the lower edge of the bottle cap to the side of the opener proximate to the handle. A spring mounted to the base engages the lever to bias the front arm downwardly and toward the U-shaped hollow portion. A magnetic appendix is hinged to the U-shaped hollow portion to the side thereof diametrically opposite the pivoted handle and extends in line with the handle for movement between a first position overlying and in contact with the top of the bottle cap in an upwardly oblique raised position with respect thereto, permitting manual removal of the cap from the appendix after the cap is separated from the bottle rim.

1 Claim, 2 Drawing Sheets

BOTTLE CAP OPENER

BACKGROUND OF THE INVENTION

The invention is directed to a bottle cap opener for removing bottle cap of carbonated beverage assuring a closing capacity to said bottle cap and producing a pleasant effect to the people around.

Specifically, the results of this invention is a cap pressure opener for a drink bottle to maintaining the taste of sodas, beer, etc. which can be placed under said bottle cap for removing it from the pressure force that is attached to the said bottle. Thus the bottle cap can be kept unalterable in its base form so that it can be used repeatedely; which is necessary and useful to keep the quality of the drink left inside the bottle, once of has been opened. All openers prededing this invention are worthless to maintain the type of bottle cap herein referred, because for them to carry out their object they are first of all put on the same cap in order to place an appendix under the lower edge of such bottle cap, that with the lifting action, the cap folds or bends, thereby loosening its holding power and becoming usless.

The other aspect of this invention consists of an additional pushing force against said bottle cap from the outside to the inside of the same bottle to release the carbonated gas found in it. When both forces are combined one gets the release of the pressure cap quickly and the carbonated gas produces a pleasant blowing sound, when coming out, similar to the one produced by a champagne bottle when removing its cork.

SUMMARY OF THE INVENTION

The object of this invention is to provide an useful device for removing pressure caps from bottles containing carbonated drinks, such as sodas, beer, etc.

A further object of this invention is to preserve in good condition the removed cap so it can be used again to permit it to conserve the remaining bottled liquid, which would lose its quality if kept uncovered for a while.

A further object of the invention is to provides a device which produces a pleasant impression to the people around when combining the cap removing action whith the quickly produced sound made from the inside of bottle by gas release to the admospheric, when the carbonated gas found in the non-filled space of the bottle suddenly leaves it.

Specifically the invention is directed to a device which rests on the middle and lower part of the head of a bottle, on which a metal pressure covering cap is used, in order to place under any specific part of the lower outer edge of the bottle cap, the one end of a lever. The lever one end rests on the upper part of the opener, and when under cap release action upward, it dosen't touch the bottle but pushes the said cap liberating it from the holding place; about the bottle head. The release of the bottle cap is inmediately interrupted by a magnetic appendix that catchs it. Any bottle cap opened this way will practically remain unaltered and so shall continue keeping a great holding power so as to be usable many times. The quikly removing action in lifting the bottle cap is accompanied by a blowing sound which is made by the proportion of carbonated sodium gas that comes out of the bottle. Such gas appears in almost all these type of drinks, used to freshen the taste. The release action of the tap as well as the provoked sound produce a pleasant impression to the people seeing such action.

DETAILED DESCRIPTION OF THE PREFERRED EMBODIMENT

Before explaining the invention, in detail, it is to be understood that the invention is not limited in its application to the details of construction and arrangements of parts illustrated in the accompanying drawings, since the invention is capable of other embodiments or appearance of its outlines.

Also, it is to be understood that the phraseology or terminology employed herein is for the purpose of description and not limitation.

Figure 1:
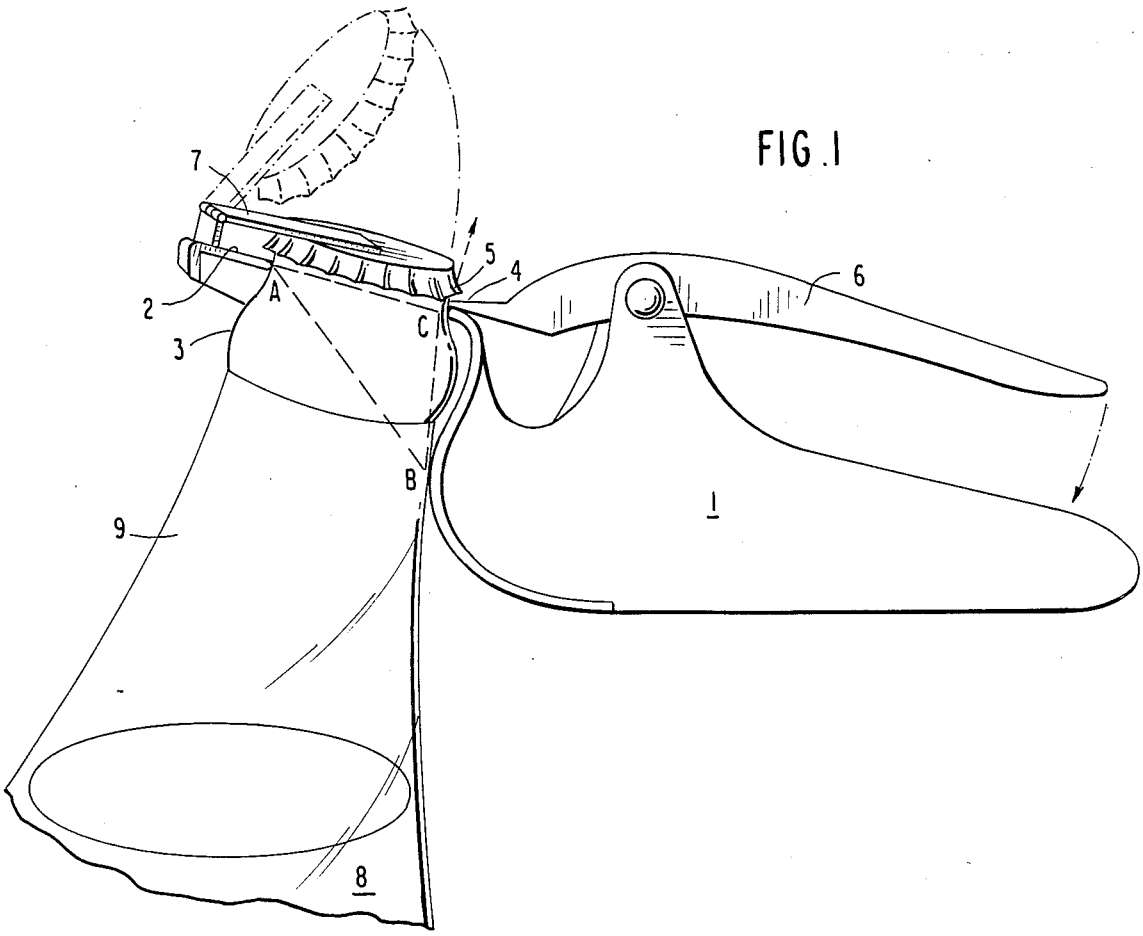
FIG. 1 is a perspective view of a bottle containing carbonated drink; which bottle is ready to be uncovered with the bottle opener of the present invention and also shows the parts of the edge of the cap in where the opener is placed on the head of the bottle and in dotted lines, the bottle cap after disattachment and inmediately caught by the magnetic appendix of the opener
Figure 2:
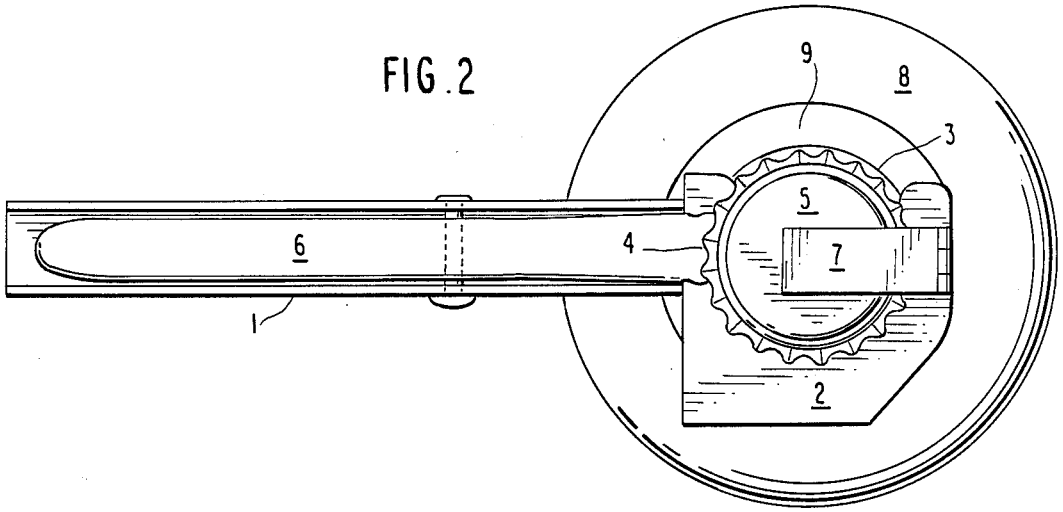
FIG. 2 is a top plan view showing clearly the location of the opener around the head of the bottle and under its cap FIGS. 3; 4 and 5 are perspective views of the invention showing all of its phisical parts from different positions and FIG. 5 also shows the mechanism of the lever as well as the spring that biases the lever return to its original position.
Figure 3:
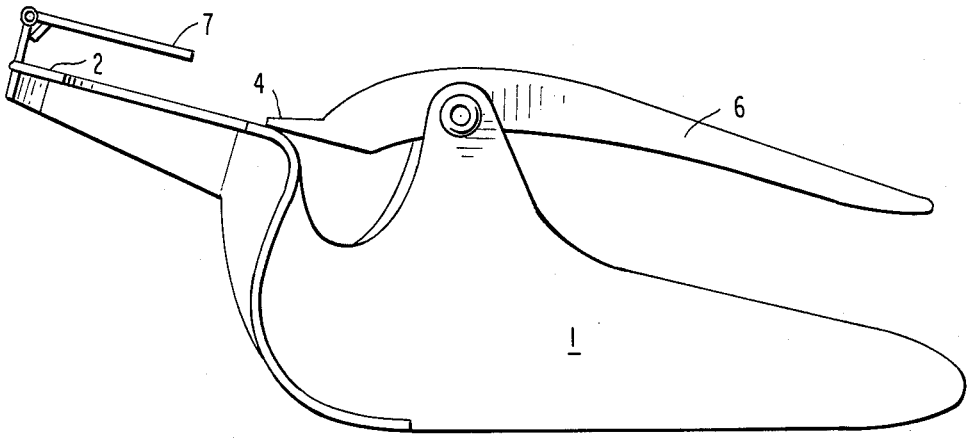
Figure 4:
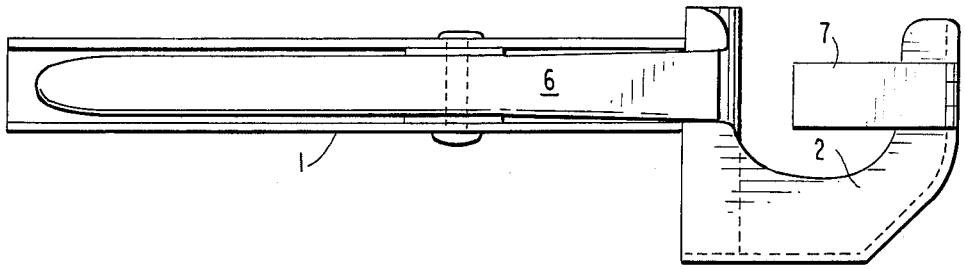

Refering now to FIG. 1, the apparatus or bottle cap opener of this invention is typically to be used on carbonated drinks utilizing a metal pressure cap on top of the said bottle, and works when base (1) is tightly clamped to the head (3) of the said bottle with a U-shaped laterally hollowed section (2), or gibbet resting tightly on the surrounding area of the same upper part of the neck of said bottle, extending to opposite ends A, B, which ends are as opposite ends and in different levels relative to the contour of the the bottle neck; A third point, C, located opposite point A, but at the neck same level relative to the bottle neck and point B, form together an imaginary triangle: A, B and C. Point C does more than support the base (1), it centers the "nail" or front end (4) of upper lever (6) on a location just under the edge of cap (5) of said bottle. Finally, by holding such bottle with one hand, normaly with the left hand, when holding the bottle opener with the other hand the back of the lever (6) is depressed with the thumb of the said right hand rotating the former end (the "nail") clockwise and passing very close but without touching the rim of the said bottle head (3) to push said bottle cap in upwards order to overcome its pressure attachment over the bottle rim. At the same time a magnetic appendix (7) hinged to gibbet (2), is positioned to catch inmediately the released bottle cap, once set free. This hinged magnetic appendix is located hollowed section (over the "gibbet") of the opener. With this pushing action referred to above, the bottle cap keeps its normal configuration and looses a minimum of its original function. In other words, it can continue to be useful to recap the bottle containing some beverage, that can be left to drink later.

In many cases, the carbonate and proper gas of the bottled drink (8) comes out of it, but not out of the bottle, being kept in the empty space (9) left inside the bottle and, depending on the pressure contained therefrom. When the bottle cap is removed in the way expressed above, the said gas escapes instantly to the atmospheric which air suddenly enters into the bottle and provokes a little turbulence in the said space (9), reflected by the production of a peculiar and pleasant to sound the air. The said sound is similar to the one produced in champagne bottle when removing its cork.

Figure 5:
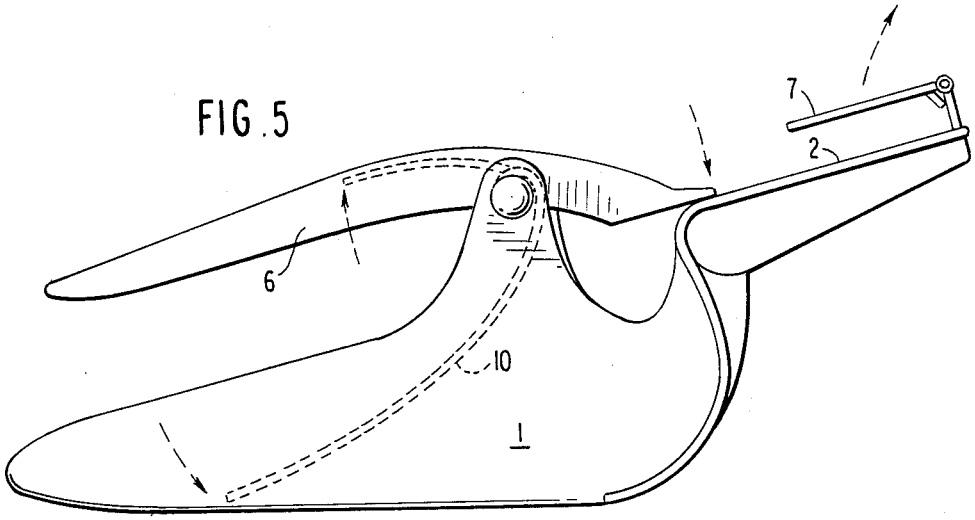

After having removed the cap, the user of this invention releases the executed pressure on the said lever so that it can automatically return to its original position, thanks to the disposition of a spring (10) under the same lever (6) (FIG. 5) the bottle cap opener is then ready to be used immediately, if desired.

What is claimed is:

1. A bottle cap opener for a quick release of a bottle cap from the rim of a carbonated drink bottle head, said opener comprising:

a fixed base, including a laterally directed, U-shaped neck embracing hollow portion for laterally receiving a portion of the neck of said bottle below said rim, a lever pivotaly mounted to and overlying said base, said lever including a front arm having an end abutting said U-shaped hollow portion of said base, and engagable with a lower edge of said bottle cap to the side of said opener proximate to said pivoted handle, a spring mounted to said base and engaging said lever to bias said front arm downwardly and toward from said U-shaped hollow portion, and a magnetic appendix hinged to said U-shaped hollowed portion, to the side thereof diametrically opposite to said pivoted handle and extending in line with said handle for movement between a first position overlying and in contact with the top of said bottle cap, and an upwardly oblique raised portion to permit manual removal of the cap from said magnetic appendix after the cap is removed from the bottle head rim, with a minimum distortion of the bottle cap and permitting recapping of the bottle.

* * * * *